United States Patent [19]

Bouman

[11] 4,138,014

[45] Feb. 6, 1979

[54] RUPTURABLE PACKAGE

[75] Inventor: Cornelis Bouman, Maasdam, Netherlands

[73] Assignee: W. van Oordt & Co. Holding B.V., Netherlands

[21] Appl. No.: 806,721

[22] Filed: Jun. 15, 1977

[51] Int. Cl.[2] ..... B65D 17/24; B65D 69/00

[52] U.S. Cl. ..... 206/542; 206/457; 206/602; 206/629; 426/115

[58] Field of Search ..... 206/217, 234, 457, 459, 206/484, 542, 548, 553, 602, 629; 229/1.5 C; 426/112, 115, 120

[56] References Cited

U.S. PATENT DOCUMENTS

| | | | |
|---|---|---|---|
| 1,514,379 | 11/1924 | Fleischer | 426/120 X |
| 2,509,616 | 5/1950 | Rafoth et al. | 229/1.5 C |
| 3,083,821 | 4/1963 | Woodson | 206/484 X |
| 3,526,317 | 9/1970 | Vanders | 206/217 |
| 3,534,887 | 10/1970 | Ginsberg | 206/602 X |
| 3,749,233 | 7/1973 | McCormick, Jr. | 206/373 |

*Primary Examiner*—Steven E. Lipman

*Attorney, Agent, or Firm*—Roylance, Abrams, Berdo & Farley

[57] ABSTRACT

A rupturable package containing ingredients for the preparation of or addition to, a drink or food. The package has two flat sheet-like walls directly interconnected by binding zones and define between them a plurality of compartments separated by such binding zones. At least some of the compartments contain different ingredients, and one of them is of elongated shape for receiving tableware, such as a stirrer, therein, and has one longitudinal edge adjoining co-extensive edges of at least two other compartments.

4 Claims, 1 Drawing Figure

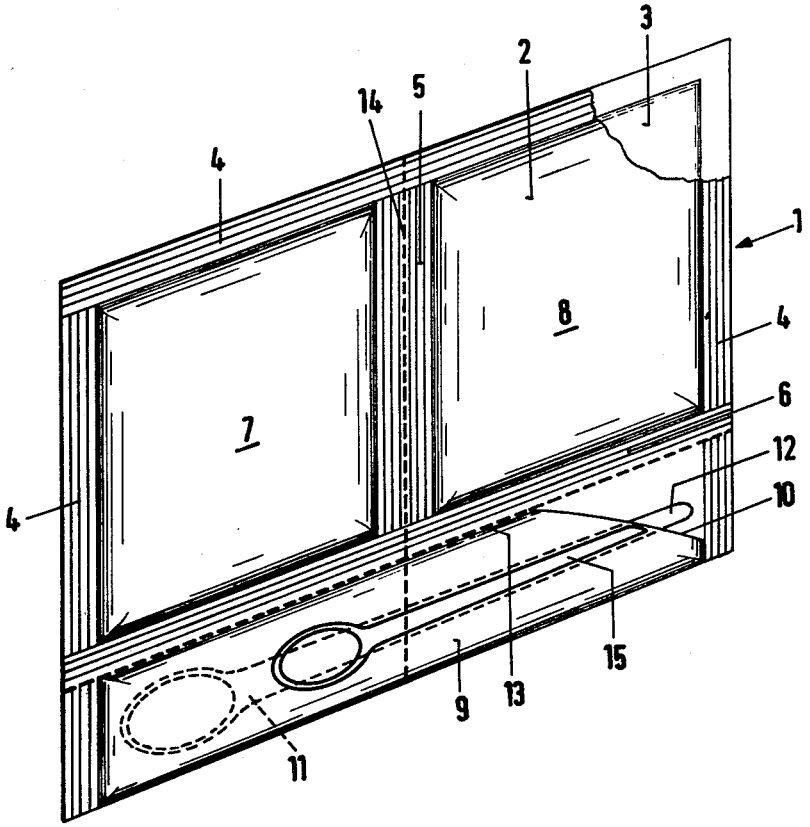
3
2
14
5
4
1
8
4
6
7
12
10
4
15
9
13
11

RUPTURABLE PACKAGE

This invention relates to a rupturable package for ingredients for the preparation of, or addition to, a drink or food.

Many of such packages have been proposed in the past, for example, for sugar — known by the name of "sugar-bags" — milk powder or a substitute therefor, coffee extract, salt pepper and mustard, which are supplied along with drinks or food, or, as is the case with coffee extract, cocoa powder, etc., may serve for the preparation of drinks or food.

In many cases, a plurality of such ingredients is necessary for the preparation of, or addition to, the drink or food, including sometimes tableware, such as a stirrer, which may be required for admixture of the additive with the drink or food.

Quite often several individual packages are packed in an additional wrapper or container, in which the several ingredients are sold as a kit, sometimes also containing the food or drink itself.

It is an object of the present invention to simplify and facilitate the supply of such ingredients in the cases referred to.

According to the present invention, there is provided a rupturable package containing ingredients for the preparation of, or addition to, a drink or food, comprising two substantially flat sheet-like walls directly interconnected by binding zones, characterized in that said substantially flat walls define between them a plurality of compartments at least some of which contain different ingredients, said compartments being separated from each other by said binding zones, and at least one of said compartments being of elongated shape with one of its longitudinal edges adjoining co-extensive edges of at least two other compartments.

There may thus be formed a plurality of side-by-side compartments according to the combination of ingredients that is required in each individual case, for example, a compartment containing sugar and one containing milk powder, or other combinations, such as pepper, salt and mustard, or mustard, vinegar, oil and egg powder, and next to these an elongated compartment for tableware, such as a stirrer.

According to a preferred feature of the present invention, at least one of the elongated compartments has an opening in one wall for allowing the passage of tableware into and out of said compartment.

Thus, for example, the package according to this invention may comprise a sugar compartment side by side with a milk powder compartment, in combination with an elongated compartment for receiving a plastic spoon. Such a composite package with ingredients can be supplied along with a cup or pot of tea, coffee, cocoa, or like beverage, so that with the single composite package the consumer has all the ingredients required to make the portion bought ready for consumption.

Preferably, weakened score lines or tear lines are formed in, or at least adjacent to, the binding zones between the compartments. This renders it possible for the user to separate the individual compartments from the composite package, which facilitates the handling of the several ingredients. It also makes it possible for the supplier, in certain cases, to reduce the composite package by removing compartments containing ingredients not required in these cases.

An additional advantage in this connection is that the separation of the compartments from each other along the tear lines results in edges being formed in the zones containing the tear lines, which in many cases are much easier to tear than the peripheral edges of the composite package, which in fact are formed by machine-cut edges of binding zone. In practice difficulties are encountered in tearing open such machine-cut edges formed in this manner: the force to be applied may be so great that the package is ruptured suddenly and too far, and a portion of the contents thereof is lost, with the added inconvenience of messy spillings. If, on the other hand, the compartment concerned is first separated from the composite package along the weakened score lines or tear lines, the compartment is much more easily ruptured to release the contents thereof at the position of one of the peripheral edge portions resulting from the tearing off of the compartment.

Conveniently, a rupturable package according to this invention in which a piece of tableware is included in one of the compartments, one end of which projects outwardly through an opening in one wall thereof, the said wall provided with the opening carries a representation of the piece of tableware substantially linking up with the end thereof extending through said opening.

One embodiment of the present invention will now be described, by way of example, with reference to the accompanying diagrammatic drawing, which shows a rupturable package according to this invention in plan view, with a portion of the front sheet being removed.

Referring to the drawings, there is shown a rupturable package for ingredients, generally designated by reference numeral 1, which comprises a pair of sheet-like, plane, substantially flat walls 2 and 3. In the drawing, a portion of the front wall 2 is broken away to show a portion or rear wall 3.

The two walls 2 and 3 are locally directly and intimately interconnected, for example, by heat-sealing, if the material of the walls is suitable therefor, to form binding zones 4 along three peripheral edges.

Further binding zones are shown at 5 and 6. Binding zone 5 separates two equally large compartments 7 and 8 between walls 2 and 3, and zone 6 separates compartments 7 and 8 from a further compartment 9 of elongated shape, which extends between one longitudinal edge of the package 1 and the aligned bottom edges of compartments 7 and 8 as viewed in the drawing.

Along the bottom longitudinal edge of the package, as viewed in the drawing, that is to say the bottom edge of compartment 9, the front and rear walls 2, 3 merge one into the other, i.e. the sheet-like material forming walls 2, 3 is folded at said edge.

Designated by reference numeral 10 is an oblique slit formed in front wall 2 in the right-hand half of compartment 9, as viewed in the drawing, and through which extends a stirrer 11, in the present case a spoon.

To the extent that spoon 11 is covered by wall 2, the spoon is shown in dash outline. The right-hand end of the spoon, as viewed in the drawing, projects from the package. At 15 a spoon is depicted on the external surface of the wall 2 of compartment 9, which on the right-hand side in the figure at the oblique slit 10, substantially links up with the projecting end 12 of spoon 11.

Weakened score lines or tear lines 13 and 14 are formed to extend, respectively, along the bottom edge of binding zone 6, as viewed in the drawing, and in the middle of binding zone 5 between compartments 7 and 8. Score line 14 may be formed to extend also centrally across compartment 9, for the latter to be easily ruptured, for example, if slit 10 is not provided.

Along these score lines the portions of the package containing the respective compartments 7, 8 and 9, can easily be separated from each other.

Once the compartments have been separated, the individual compartments can easily be ruptured beginning at one of the edges formed by the separation. In fact, at these positions the material is more easily torn that at a position along the peripheral edge of binding zones 4.

In the present case, compartments 7 and 8 are contemplated to be filled with sugar and a powdered milk substitute, respectively, for being supplied or served along with coffee or tea.

Naturally numerous variations are possible without departing from the scope of the invention both as regards the composition and diversity of the individual ingredients, and as regards the shape and dimensions of the compartments, and also as regards the kind of tableware to be supplied in the form of a knife, fork or spoon or the like, of which, if desired, a combination, such as a knife and a fork, may be accommodated in the composite rupturable package according to the invention.

Also, the invention is not intended to be limited to any particular material to be used for the package. A great variety of commercially available, well-known sheet materials are suitable for making packages according to this invention.

I claim:

1. A rupturable package containing ingredients for the preparation of, or addition to, a drink or food, comprising:

two generally planar sheet-like walls directly interconnected by binding zones, said walls defining between them a plurality of compartments at least some of which contain different ingredients, said compartments being separated from each other by some of said binding zones, and at least one of said compartments being of elongated shape with one of its longitudinal edges adjoining co-extensive edges of at least two other compartments, said elongated compartment adapted to contain a utensil, said binding zones further including at least two inner binding zones having weakened tear lines formed in or at least adjacent thereto between said compartments, said tear lines intersecting each other and being perpendicular, one of said tear lines extending between said elongated compartment and said two other compartments to provide easy severance of said two other compartments from said elongated compartment, the other of said tear lines extending between said two other compartments and across said elongated compartment to provide easy severance of said two other compartments from each other and to provide easy opening by severance of said elongated compartment along the tear line extending thereacross.

2. A rupturable package according to claim 1, wherein said binding zones include three outer binding zones on three peripheral edges of said walls and a fourth outer binding zone on a fourth peripheral edge of said walls, said fourth outer binding zone comprising an integral fold line between said walls.

3. A rupturable package according to claim 1, wherein at least one of the elongated compartments has an opening in one wall for allowing the passage of tableware into and out of said compartment.

4. A rupturable package according to claim 1, wherein at least one of the elongated compartments has an opening in one wall for allowing the passage of a piece of tableware into and out of said compartment, said wall carrying a representation of said piece of tableware extending up to the opening in said wall to link up with a projecting end of the piece of tableware contained in said compartment.

* * * * *